US008259976B2

(12) United States Patent
van Halteren

(10) Patent No.: US 8,259,976 B2
(45) Date of Patent: Sep. 4, 2012

(54) ASSEMBLY COMPRISING A SOUND EMITTER AND TWO SOUND DETECTORS

(75) Inventor: Aart Zeger van Halteren, Hobrede (NL)

(73) Assignee: Sonion Nederland B.V., Amsterdam (NL)

( * ) Notice: Subject to any disclaimer, the term of this patent is extended or adjusted under 35 U.S.C. 154(b) by 645 days.

(21) Appl. No.: 12/417,181

(22) Filed: Apr. 2, 2009

(65) Prior Publication Data

US 2009/0252361 A1 Oct. 8, 2009

Related U.S. Application Data

(60) Provisional application No. 61/072,709, filed on Apr. 2, 2008.

(51) Int. Cl.
*H04R 25/00* (2006.01)

(52) U.S. Cl. ..... 381/328; 381/313

(58) Field of Classification Search ..... 381/312, 381/313, 328
See application file for complete search history.

(56) References Cited

U.S. PATENT DOCUMENTS

| | | | | |
|---|---|---|---|---|
| 6,661,901 | B1 | 12/2003 | Svean et al. | |
| 7,302,748 | B2 | 12/2007 | Jiles et al. | |
| 7,983,433 | B2 * | 7/2011 | Nemirovski | 381/318 |
| 2005/0254673 | A1 | 11/2005 | Hsieh et al. | |
| 2007/0147635 | A1 | 6/2007 | Dijkstra et al. | |
| 2008/0187163 | A1 | 8/2008 | Goldstein et al. | |
| 2009/0074220 | A1 * | 3/2009 | Shennib | 381/325 |
| 2009/0129619 | A1 * | 5/2009 | Nordahn | 381/328 |

FOREIGN PATENT DOCUMENTS

EP 1895811 A2 3/2008

* cited by examiner

*Primary Examiner* — Matthew E Warren
(74) *Attorney, Agent, or Firm* — Nixon Peabody LLP

(57) ABSTRACT

The invention relates to an assembly comprising a sound emitter and at least two sound detectors fixed to each other, wherein each detector has a sound receiving opening. The sound receiving openings of at least two of the detectors point in opposite directions.

10 Claims, 1 Drawing Sheet

ASSEMBLY COMPRISING A SOUND EMITTER AND TWO SOUND DETECTORS

CROSS REFERENCE TO RELATED APPLICATIONS

This application claims the benefit of U.S. Provisional Patent Application Ser. No. 61/072,709, filed Apr. 2, 2008, titled "An Assembly Comprising a Sound Emitter and Two Sound Detectors," which is incorporated herein in its entirety.

FIELD OF THE INVENTION

The present invention relates to an assembly comprising two sound detectors and a sound emitter.

SUMMARY OF THE INVENTION

In a first aspect, the invention relates to an assembly comprising a sound emitter and at least two sound detectors fixed to each other, wherein each detector has a sound receiving opening. The sound receiving openings of at least two of the detectors point in opposite directions.

In the present context, a sound emitter may be any element adapted to output sound corresponding to an electrical signal, such as a loudspeaker or a so-called "receiver". This emitter may be based on any driving technology, such as electret, moving coil, moving armature, moving magnet, or the MEMS technology presently being very well received as microphones in the hearing aid industry.

In addition, a sound detector may be any type of sound detector, such as a microphone. Many sound detectors are based on the above-mentioned basic technologies, including the MEMS microphones, also used in sound providers/emitters. The detectors may be based on different detection technologies and are also not dependent on the technology of the emitter.

The emitter and detectors may be fixed to each other in any suitable manner, such as welding, soldering, adhesion/glue, mechanical fixing (screws, clamps or the like). This fixing may be permanent or detachable.

A sound receiving opening may simply be an opening in a surface of the detector, whereby the direction thereof may be taken as a direction directly away from, or perpendicular to, this surface. Other detectors have tubes/spouts or other elements defining an elongate path along which sound is directed from outside to inside the detector. In this situation, the direction will be defined by such an element.

Also, "opposite" directions normally will mean parallel or at least substantially parallel, but oppositely directed, directions.

In one embodiment, the sound emitter has a sound emitting opening pointing in one direction, and wherein the sound receiving opening of at least one of the detectors points in the one direction. Naturally, the above manners of defining a sound receiving opening may be used also for defining a sound emitting opening. Also, the sound emitting opening and a sound receiving opening will be pointing in the same direction, if these point in directions no more than 10 degrees, such as no more than 5 degrees, preferably no more than 2 degrees from each other.

In one embodiment, each of the emitter and the detectors comprises a plurality of electrically conducting parts. The assembly further comprises a set of externally conducting elements normally not forming part of the housing but being solder bumps, connectors, cables or the like electrically connected to elements within the housing(s). At least one of the external conducting elements is electrically connected to a conducting part of both the emitter and each of the detectors. In standard emitters and detectors, such electrically conducting parts may be solder bumps or cables/connectors allowing electrical connection to elements inside the emitter/detectors.

Preferably, the electrically conducting parts of the emitter are parts adapted to receive an electrical signal to be converted into sound. Normally, the emitter will have a driver, typically based on one of the above-mentioned techniques, which converts an electrical signal into sound. The electrically conducting parts are adapted to convey this electrical signal from outside the emitter to that driver.

The electrically conducting parts of a detector may be parts adapted to output an electrical signal corresponding to the sound received or detected. Again, the detector normally has a detecting element based on one of the above-mentioned techniques, and the electrically conducting parts are then adapted to convey the electrical signal from the detecting element to surroundings of the detector.

The at least one external conducting element will typically be connected to ground or the housing of the detectors/emitter, as this normally has the same purpose in all such elements.

In a particularly preferred embodiment, the emitter comprises a housing having therein an amplifying circuit. The assembly further comprises first electrical conductors connecting at least one of the detectors to the amplifying circuit. In one embodiment, the assembly has first electrical conductors connecting both detectors to the amplifying circuit or a plurality of amplifying circuits positioned in the emitter housing.

Standard sound detectors have or require an amplifier for amplifying the quite weak electrical signal output there from before transmitting the signal to more remote equipment. In the present embodiment, this amplifying circuit is positioned in the emitter. Then, the device may be made smaller as no extra space is required for the amplifiers in or outside the detectors. An alternative would be the reduction of volume of the emitter which, however, may render the space reduction unduly complicated. A single amplifying circuit may be used for amplifying the signals of both microphones, and the same circuit may also be used for performing other processing, such as filtering, of signals, such as to generate a signal for the emitter.

In this embodiment, the emitter preferably has a driving element, the assembly further comprising second electrical conductors connecting the driving element to the amplifying/processing circuit.

In one embodiment, the emitter and the detectors each comprises a housing. Normally, a housing or wall parts thereof is a monolithic or single layer element having on one side the inner space (such as the so-called back or front chamber) of the detector/emitter in which sound is generated or detected, and on the other side the exterior or surroundings of the emitter/detector. The emitter housing and at least one of the detector housings sharing a common wall part, whereby this wall part on one side forms part of an inner space of the emitter (the inner space being the space in which sound is generated) and on the other side forms part of an inner space of the at least one detector (the inner space being a space in which sound is detected). In this connection, a common wall part is a single element forming a wall part of both the emitter and the detector. Thus, instead of simply providing these elements as they would be manufactured individually, walls may be shared, whereby the overall assembly becomes smaller and lighter.

In this respect, the invention also relates to a method of providing the above assembly where the at least one detector or the emitter is provided with a housing and the other is provided with an opening in a side of the housing or with a side of the housing missing, which opening or missing side is closed or formed by a side of the housing of the other of the at least one detector or the emitter. The opening or side may be provided in the housing during or after manufacture of the detector/emitter. A side may be removed from a detector/emitter initially provided with a housing with no missing sides. This closing or forming may be obtained by fixing the at least one detector and the emitter to each other. Naturally, the opening or missing side may be closed by not only a single emitter/detector but a number thereof. Also, a number of detectors/emitters may be provided with openings or missing sides, which are then closed by a single or multiple detectors/emitters.

In another embodiment, the assembly may be adapted to be positioned within the ear canal of a user. The emitter is adapted to emit sound into the canal. A first of the detectors has its sound receiving opening directed into the canal. And, a second of the detectors has its sound receiving opening directed outwardly of the canal, in relation to the position of the assembly. The assembly further comprises a circuit adapted to receive a first signal from the first detector, a second signal from the second detector and provide, to the emitter, a signal e.g. compensating for sound represented by the second signal. In this situation, compensation may be counteracting by simply adding a signal in counter phase to the noise signal.

Thus, the detectors are directed along the length of the canal—normally one directed in one direction and the other along the opposite direction. The emitter is directed so as to output sound in the direction into the canal toward the eardrum.

In one embodiment, the assembly further comprises means for positioning and/or fixing the assembly within an ear canal of a person. This fixing may be by specially shaped elements adapted to fit inside the particular ear canal of the particular user, or may be more generally shaped, such as resilient elements adapted to fit into multiple user's ear canals.

In one situation, the positioning means is adapted to, when positioned inside the ear canal of the person, at least substantially block/prevent sound from outside the ear from passing the means and impinging on the eardrum. This has the advantage that feedback may be prevented from the output of the emitter to a detector having a sound receiving opening at the other side of the positioning means.

In another situation, the positioning means is adapted to, when positioned inside the ear canal of the person, allow sound from outside the ear from passing the means. This allowing may be obtained by the positioning means having therein openings or channels allowing sound to pass from the emitter opening to the opening of the second detector.

In a particularly interesting embodiment, the emitter is a balanced receiver being an emitter comprising two at least substantially parallel diaphragms and two driving means (which may be of the same or different types) acting to move the diaphragms in opposite directions, or counter-phase, on the basis of one and the same electrical signal. In this manner, vibrations caused by sound generation may be reduced.

In another embodiment, the at least one sound detector comprises a MEMS element adapted to detect sound. These elements have a number of advantages in e.g. a reduced size.

BRIEF DESCRIPTION OF THE DRAWINGS

In the following, preferred embodiments will be described with reference to the drawing, wherein.

DETAILED DESCRIPTION OF THE INVENTION

Figure 1:
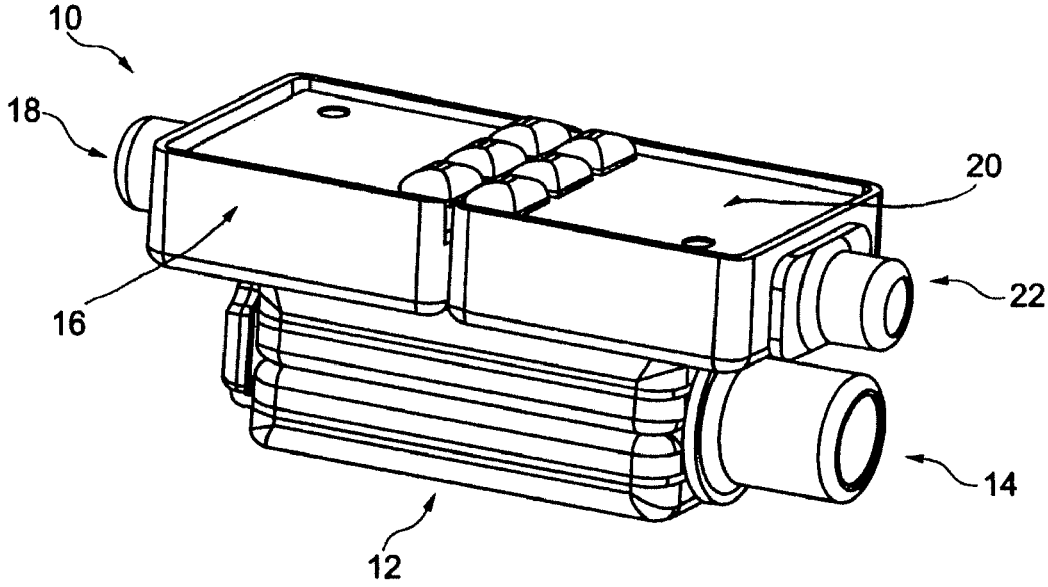
FIG. 1 illustrates a first assembly according to the invention.

FIG. 1 illustrates a general type of embodiment in which an assembly 10 has a sound generator or receiver 12, having a sound output 14, as well as two sound detectors or microphones 16 and 20 having respective sound receiving openings 18 and 22.

The receiver 12 and microphones 16 and 20 are fixed to each other either permanently or detachably, such as by glue/adhesive, welding, soldering, mechanical fixing or the like.

It is seen that the opening or spout 22 of microphone 20 is directed in the general direction of opening or spout 14 of the receiver 12, and that the opening/spout 18 of the microphone 16 is directed in the opposite direction. This may be used for a number of purposes as will be seen further below.

Naturally, the spouts 22 and 14 may be combined into one spout, or an opening from the receiver 12 into the microphone 20 may be used in order to use only a single opening or output. Then, this single output or spout will be that of both the elements.

Figure 2:
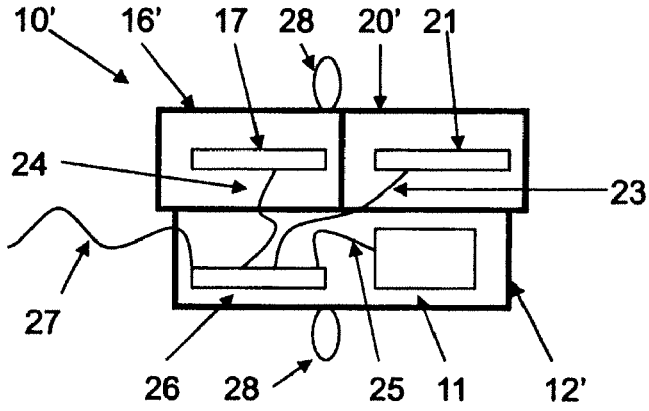
FIG. 2 illustrates a second assembly according to the invention.

FIG. 2 illustrates a slightly different embodiment, in which the openings/spouts are not illustrated but will generally be positioned/directed as in FIG. 1.

In the assembly 10' of FIG. 2, the receiver 12' has therein a sound generating element 11, which may be any type of sound generator, such as a loudspeaker, electret, a piezo element, a generator based on the moving armature or the moving coil, moving magnet principle, a Silicon based element, such as a MEMS element, or the like. This element 11 receives an electrical signal via a wire or wires 25.

In addition, the microphones 16' and 20' have respective sound receiving elements 17 and 21, which may generally be based on the same principles as those of element 11, and which generate electrical signals and output these over wires 23 and 24.

The receiver 12' further comprises an element 26, such as a PCB, an ASIC or the like, connected to the wires 23, 24, 25 and outputting and/or receiving an electrical signal and/or power via a cable 27.

Depending on the application, it may be desired to have the element 26 comprise signal processing equipment. This is described further below.

An advantage of the element 26 and the common cable 27 is that the overall number of wires required to and from the assembly 10' may be reduced in that one wire of cable 27 may be connected to more than one of the receiver and microphones, such as a ground connection. Comparing to the assembly 10 of FIG. 1, where one wire may be required to/from each solder bump of each microphone and the receiver. The same may be obtained if the housings of the microphones/receiver are electrically conducting by ensuring an electrical connection between the housings. In that situation, the housings may simply be used instead of a separate wire, and the connections there between will provide this common electrical connection.

In addition, if the signal from one microphone 16/20 is not required outside the assembly but is only used for correcting/adapting an output of the receiver 12, additional wires are saved between the assembly and the surroundings.

Also, it is noted from FIG. 2 that walls are shared between the receiver 12' and microphones 16' and 20' making the overall assembly lighter and smaller. In an embodiment for use in a persons ear canal, this is of importance, and this feature could save a wall thickness (0.1-0.15 mm) in the total thickness of the device.

The above assembly may be used in a number of applications, several of which are at a position inside the ear canal of a user, and others being behind or outside the ear of a person. Naturally, the assembly is applicable also in applications not related to hearing aids.

In one application, the assembly is positioned inside the ear canal of a person, such as using engaging means 28 adapted to position the assembly inside the canal. In this first application, the means 28 do not fully prevent sound from outside the ear from entering the canal and impinging on the ear drum of the person. The means 28 can be a structure extending away from a portion of the housing of the assembly 10', as shown in FIG. 2, and may be comprised of a resilient or flexible material.

Thus, sound from outside the ear will mix with the sound from the receiver 12/12' and be detected by the microphone 20/20', and sound from the receiver 12/12' will exit the canal and mix with the sound from outside the ear and be detected by the microphone 16/16'.

This partially open embodiment has the advantage that the so-called occlusion will not take place, but the disadvantage that the feedback may cause irritating feedback in the receiver 12/12' and microphone 16/16' being positioned very closely. The microphone 20/20' may, however, be used for sensing this unwanted feedback and for controlling a DSP (or the like) processing the signal from the main microphone 16/16' before feeding the signal to the receiver 12/12' to take this feedback into account, such as by filtering away or damping the frequency of the feedback.

In another ITC (In The Canal) embodiment, the means 28 are adapted to substantially block sound from the outside of the ear to reach the inner parts of the canal and thus the microphone 20/20' and sound from the receiver output 22 from reaching the outer ear and the microphone 16/16'.

In this situation, the feedback problem may be solved, but the occlusion effect may be present. Occlusion is the effect experienced if the ears of a person are blocked while the person speaks.

However, a comparison of the sound or frequency spectrum (or whatever other comparisons are desired) between the sound output of the receiver 12/12' or received by the microphone 20/20' and that received by the microphone 16/16' may be used for handling occlusion or other noise sources in order to adapt the sound output of the receiver 12/12' to obtain any desired output.

In addition, the sound determined by the microphone 20/20' may also be used for comparing the output of the receiver 12/12' to a predetermined output, such as a frequency response stored in a DSP or memory of the assembly, in order to calibrate or check the assembly.

For embodiments used outside the ear canal of the person, the two microphones 16/16' and 20/20' may be used as a directional microphone. In this type of set-up, the microphones are either a matched pair, or a DSP may be used for 'matching' the microphones.

As mentioned above, the receiver 12 may be a balanced receiver in order to avoid or reduce the vibrations caused by sound generation.

The invention claimed is:

1. An assembly adapted to be positioned within the ear canal of a user, the assembly comprising a sound emitter and at least two sound detectors fixed to each other, wherein:

each detector has a sound receiving opening, the sound receiving openings of at least two of the detectors pointing in opposite directions, the sound emitter has a sound emitting opening pointing in one direction and being adapted to emit sound into the canal, the sound receiving opening of at least one of the detectors points in the one direction and into the canal, and a second of the detectors has its sound receiving opening directed outwardly of the canal, the assembly further comprising a circuit adapted to receive a first signal from the first detector, a second signal from the second detector, and to provide, to the emitter, a signal compensating for sound represented by the second signal.

2. An assembly according to claim 1, wherein each of the emitter and the detectors comprises a plurality of electrically conducting parts, the assembly further comprising a set of external conducting elements, at least one of the external conducting elements being electrically connected to a conducting part of both the emitter and each of the detectors.

3. An assembly according to claim 1, wherein the emitter comprises a housing having therein an amplifying circuit, the assembly further comprising first electrical conductors connecting at least one of the detectors to the amplifying circuit.

4. An assembly according to claim 3, wherein the emitter has a driving element, the assembly further comprising second electrical conductors connecting the driving element to the amplifying circuit.

5. An assembly according to claim 1, wherein the emitter and the detectors each comprises a housing, the emitter housing and at least one of the detector housings sharing a common wall part.

6. An assembly according to claim 1, further comprising means for positioning and/or fixing the assembly within an ear canal of a person.

7. An assembly according to claim 6, wherein the positioning means are adapted to, when positioned inside the ear canal of the person, at least substantially block sound from outside the ear from passing the means.

8. An assembly according to claim 6, wherein the positioning means are adapted to, when positioned inside the ear canal of the person, allow sound from outside the ear from passing the means.

9. An assembly according to claim 1, wherein the emitter is a balanced receiver.

10. An assembly according to claim 1, wherein the at least one sound detector comprises a MEMS element adapted to detect sound.

* * * * *